United States Patent [19]

Fischer

[11] 4,257,913

[45] Mar. 24, 1981

[54] STABLE MANGANESE SALT SOLUTIONS AND A PROCESS FOR THEIR PRODUCTION

[75] Inventor: Alfred Fischer, Forest Hills, N.Y.

[73] Assignee: Tenneco Chemicals, Inc., Saddle Brook, N.J.

[21] Appl. No.: 76,523

[22] Filed: Sep. 17, 1979

[51] Int. Cl.[3] ..... B01F 17/30; C07F 1/00

[52] U.S. Cl. ..... 252/356; 260/414; 260/429 R

[58] Field of Search ..... 260/414, 429 R; 252/356

[56] References Cited

U.S. PATENT DOCUMENTS

| | | | |
|---|---|---|---|
| 2,236,296 | 3/1941 | Minich | 260/429 R |
| 2,251,798 | 8/1941 | Meidert | 260/429 R |
| 2,287,116 | 6/1942 | Minich | 260/414 |
| 2,456,824 | 12/1948 | Fischer | 260/414 |
| 2,584,041 | 1/1952 | Nowak | 260/414 |
| 2,596,371 | 5/1952 | Chadwick | 260/429 R |
| 2,807,553 | 9/1957 | Fischer | 106/310 |

*Primary Examiner*—John F. Niebling
*Attorney, Agent, or Firm*—Evelyn Berlow

[57] ABSTRACT

Stable solutions that contain at least 6% by weight and preferably 8% to 12% by weight of dissolved manganese comprise an organic solvent, manganese salts of a saturated branched-chain aliphatic monocarboyxlic acid component that contains one or more alpha, alpha-disubstituted acids having 5 to 28 carbon atoms and one or more beta-substituted acids having 6 to 18 carbon atoms, and not more than 25%, based on the weight of dissolved manganese, of a peptizing agent.

24 Claims, No Drawings

STABLE MANGANESE SALT SOLUTIONS AND A PROCESS FOR THEIR PRODUCTION

This invention relates to oil-soluble manganese salt compositions and to stable solutions of these compositions that contain at least 6% by weight of dissolved manganese. It further relates to a process for the preparation of these manganese salt solutions.

Manganese salts of aliphatic monocarboxylic acids have found widespread use in industry. They are used, for example, as driers for paints, varnishes, and printing inks; as stabilizers for various resinous compositions; as catalysts for chemical processes; and as additives for fuel oils, greases, and lubricating oils. In these and other applications, it is preferred that the manganese salts be dissolved in organic solvents to form stable solutions that have low viscosities even at relatively high metal concentrations.

The manganese salt compositions that have been used heretofore in these applications have been solutions of manganese salts of straight-chain and/or branched-chain aliphatic monocarboxylic acids of intermediate chain length. In order to obtain stable, low viscosity solutions of these salts that contain at least 6% and preferably 8% to 12% by weight of dissolved manganese, it is necessary to incorporate into the solutions sizeable amounts of peptizing agents that function as stabilizers, viscosity-reducing agents, and/or solubilizers. Amounts of peptizing agent ranging from 40% to 100% or more, based on the weight of dissolved manganese, are commonly needed to impart the required fluidity and storage stability to manganese salt solutions. The presence of these large amounts of peptizing agent in the manganese salt solutions not only raises their cost, but also may lead to unsatisfactory results in some applications. For example, in drier compositions, the peptizing agent may inhibit the activity of the cobalt salts that are usually used in combination with the manganese salts and reduce their effectiveness, thereby making it necessary to use larger proportions of the more costly cobalt salts. In fuel oil compositions, the peptizing agent may reduce the effectiveness of the manganese salts as soot removers, combustion improvers, and the like.

This invention relates to stable, low viscosity manganese salt solutions that contain at least 6% by weight and preferably 8% to 12% by weight or more dissolved manganese and not more than 25%, based on the weight of dissolved manganese in the solution, of a peptizing agent.

The manganese salt solutions of this invention comprise an organic solvent and one or more manganese salts derived from two structurally-different saturated, branched-chain, aliphatic monocarboxylic acids. Solutions having excellent fluidity and storage stability result when the manganese salt compositions are derived from a saturated, branched-chain, aliphatic monocarboxylic acid component that contains 40 to 75 mole percent of a first acid component that contains one or more alpha, alpha-disubstituted acids having 5 to 28 carbon atoms and 25 to 60 mole percent of a second acid component that contains 50 to 100 mole percent of one or more beta-substituted acids having 6 to 18 carbon atoms and 0 to 50 mole percent of one or more acids substituted in the gamma position, the delta position, or a chain position further removed from the carboxyl group. Solutions that contain manganese salts of an acid mixture that contains 45 to 55 mole percent of alpha, alpha-disubstituted acids having 7 to 13 carbon atoms and 45 to 55 mole percent of a second acid component that contains 75 to 100 mole percent of one or more beta-substituted acids having 7 to 10 carbon atoms and 0 to 25 mole percent of one or more acids substituted in the gamma position, the delta position, or a chain position further removed from the carboxyl group are generally preferred. Solutions that have particularly advantageous combinations of properties result when the manganese salt composition is derived from a mixture of branched-chain acids that contains substantially equimolar amounts of the alpha, alpha-disubstituted acid component and the beta-substituted acid-containing component. These solutions require the addition of not more than 25%, preferably not more than 20%, based on the weight of dissolved manganese in them, of a peptizing agent to reduce their viscosities to the desired level, to improve their filterability, and to increase their storage stability. In some cases, stable, low viscosity manganese salt solutions are obtained without the addition of a peptizing agent.

The manganese salt solutions of this invention may be prepared by any suitable and convenient procedure. For example, they may be prepared by double decomposition processes, by metal-organic acid reaction processes, or by metal oxide-organic acid reaction processes. Alternatively, they may be prepared by mixing a solution of a manganese salt of an alpha, alpha-disubstituted acid with a solution of a manganese salt of a beta-substituted acid and heating the resulting solution until it is homogeneous. They may also be prepared by dissolving manganese salts of the branched-chain acids in an organic solvent. The manganese salt solutions are preferably prepared by forming a reaction mixture that comprises manganous oxide, at least one alpha, alpha-disubstituted acid, at least one beta-substituted acid, an organic solvent, and, optionally, a catalyst that may be formic acid, acetic acid, propionic acid, water, or a mixture thereof, and heating the reaction mixture at a temperature in the range of about 90° C. to 125° C. until almost all of the manganous oxide has reacted. The reaction mixture is then heated to remove water and filtered to remove unreacted manganous oxide and other solid impurities from it. A peptizing agent may be added to the reaction mixture before the water-removal step or after this step to improve the filterability and stability of the solution and/or to reduce its viscosity. After adjustment of their manganese contents to the desired level, the manganese salt solutions prepared in this way can be used without purification or other treatment as paint driers, as fuel oil additives, or in other applications.

The products prepared in this way contain mixed manganese salts of alpha, alpha-disubstituted acids and beta-substituted acids alone or in combination with manganese salts of alpha, alpha-disubstituted acids and/or manganese salts of an acid component that contains beta-substituted acids or a mixture of beta-substituted acids and acids substituted in a chain position further removed from the carboxyl group. These manganese salt compositions are soluble in linseed oil and other paint vehicles and in fuel oils.

The alpha, alpha-disubstituted acids that can be used in the preparation of the manganese salt compositions of this invention are saturated, branched-chain, aliphatic monocarboxylic acids that have 5 to 28 carbon atoms, preferably 7 to 13 carbon atoms, and that have two alkyl substituents in the alpha- or 2-position of the chain, each of which has 1 to 4 carbon atoms. In addition to the two substituents in the alpha position, the acids may have alkyl substituents in one or more of the other chain positions. Illustrative of these alpha, alpha-disubstituted acids are the following: trimethylacetic acid, 2,2-dimethylbutanoic acid, 2,2-dimethylpentanoic acid, 2-ethyl-2-methylbutanoic acid, 2,2,3-trimethylbutanoic acid, 2,2-dimethylhexanoic acid, 2-ethyl-2-methylpentanoic acid, 2,2,3-trimethylpentanoic acid, 2,2,4-trimethylpentanoic acid, 2,2,3,3-tetramethylbutanoic acid, 2,2-dimethylheptanoic acid, 2-ethyl-2-methylhexanoic acid, 2,2,5-trimethylhexanoic acid, 2-propyl-2-methylpentanoic acid, 2-isopropyl-2,3-dimethylbutanoic acid, 2,2-dimethyloctanoic acid, 2-isopropyl-2,3-dimethylhexanoic acid, 2,2-diethyl-3-methylheptanoic acid, 2,2-dimethyldecanoic acid, 2-ethyl-2-methyldecanoic acid, 2,2,4,4-tetramethyldecanoic acid, and the like. Either a single alpha, alpha-disubstituted acid or a mixture of these acids can be used in the preparation of the manganese salt solutions. It is generally preferred that commercially-available mixtures of the alpha, alpha-disubstituted acids, for example, those whose composition is given in Table I, be used.

TABLE I

| Commercially-Available Mixtures of alpha, alpha-Disubstituted Acids | |
|---|---|
| Acid Mixture | Composition (approximate) |
| Neoheptanoic Acid | 95% 2,2-Dimethylpentanoic Acid<br>5% 2-Ethyl-2-methylbutanoic Acid |
| Neooctanoic Acid | 39% 2,2-Dimethyl $C_6$ Acids<br>61% 2-Methyl-2-higher alkyl Acids |
| Neononanoic Acid | 55% 2,2,4,4-Tetramethylpentanoic Acid<br>45% 2-Isopropyl-2,3-dimethylbutanoic Acid |
| Neodecanoic Acid | 31% 2,2-Dimethyl $C_{10}$ Acids<br>67% 2-Methyl-2-higher alkyl Acids<br>2% 2,2-Di-higher alkyl $C_{10}$ Acids |
| Neotridecanoic Acid | Mixture of isomeric $C_{13}$ acids in which there are two alkyl substituents in the alpha-position |
| Neo Acids, $C_9$ thru $C_{13}$ | 38% Neo $C_9$ Acids<br>45% 2,2,4,4-Tetramethylpentanoic Acid<br>40% 2-Isopropyl-2,3-dimethylbutanoic Acid<br>15% Other Neo $C_9$ Acids<br>51% Neo $C_{10}$ Acids<br>31% 2,2-Dimethyl $C_{10}$ Acids<br>67% 2-Methyl-2-higher alkyl $C_{10}$ Acids<br>2% 2,2-Di-higher alkyl $C_{10}$ Acids<br>2% Neo $C_{11}$ and $C_{12}$ Acids<br>9% Neo $C_{13}$ Acids |
| Neo Acids, $C_5$ thru $C_{25}$ | 4% Neo $C_{5-8}$ Acids<br>38% Neo $C_9$ Acids<br>45% Neo $C_{10}$ Acids<br>10% Neo $C_{13}$ Acids<br>3% Neo $C_{18-25}$ Acids |
| Neo Acids, $C_{10}$ thru $C_{28}$ | 36.5% Neo $C_{10}$ Acids<br>30.0% Neo $C_{13-18}$ Acids<br>33.5% Neo $C_{19-28}$ Acids |

The acid component that is used in combination with the alpha, alpha-disubstituted acid component contains 50 to 100 mole percent of one or more beta-substituted acids that have 6 to 18 carbon atoms, preferably 7 to 10 carbon atoms, and that have an alkyl group having 1 to 3 carbon atoms as substituent in the beta- or 3-position of the chain. These acids may also have lower alkyl substituents in one or more of the chain positions further removed from the carboxyl group. Illustrative of the useful beta-substituted acids are the following: 3-methylpentanoic acid, 3-methylhexanoic acid, 3-methylheptanoic acid, 3-ethylhexanoic acid, 3,4-dimethylhexanoic acid, 3,5-dimethylhexanoic acid, 3,5,5-trimethylhexanoic acid, 3-isopropylheptanoic acid, 3,3-dimethyloctanoic acid, 3-methyl-5-ethyloctanoic acid, 3-ethyldecanoic acid, 3,4-diethyldecanoic acid, 3,5,5-triethyldodecanoic acid, and the like. There may be a single beta-substituted acid or a mixture of two or more of these acids in this acid component. The beta-substituted acid component also contains 0 to 50 mole percent of one or more acids in which the lower alkyl substituent closest to the carboxyl group is in the gamma- or delta-position. Illustrative of these acids are 4-methylhexanoic acid, 5-ethylhexanoic acid, 4,5-dimethylhexanoic acid, 5-methylheptanoic acid, 4-ethylnonanoic acid, 4-isopropylnonanoic acid, 4,5,5-trimethylhexanoic acid, 4,8-dimethylnonanoic acid, 4,5-diethyldodecanoic acid, and the like. Commercially-available acid mixtures that contain at least 50 mole percent of beta-substituted acids are preferably used. The composition of some of these mixtures of acids is given in Table II.

TABLE II

| Commercially-Available Mixtures of Beta-substituted Acids | |
|---|---|
| Acid Mixture | Composition (approximate) |
| Isooctanoic Acid | 20% 3,4-Dimethylhexanoic Acid<br>30% 3,5-Dimethylhexanoic Acid<br>30% 4,5-Dimethylhexanoic Acid<br>10% 3-Methylheptanoic Acid<br>10% 5-Methylheptanoic Acid |
| Isononanoic Acid | 95% 3,5,5-Trimethylhexanoic Acid<br>5% 3,4,5-, 3,4,4-, and 4,5,5-Trimethylhexanoic Acids |
| Isodecanoic Acid | Isomeric trimethylheptanoic acids in which the methyl substituent closest to the carboxyl group is in the beta-position |
| Isotridecanoic Acid | Isomeric tetramethylnonanoic acids in which the methyl substituent closest to the carboxyl group is in the beta-position |

The manganese salt compositions are dissolved in inert organic solvents that are hydrocarbons or mixtures that contain major amounts of hydrocarbons and minor amounts of chlorinated hydrocarbons, ether-alcohols, and the like. The hydrocarbons that can be used include mineral spirits, kerosene, naphtha, n-hexane, n-heptane, n-octane, cyclohexane, cycloheptane, benzene, toluene, xylene, dipentene, turpentine, and other commonly-available economical hydrocarbons having low toxicity and odor. Illustrative of the solvents that can be used in combination with hydrocarbons are chloroform, carbon tetrachloride, trichloroethylene, chlorobenzene, chlorotoluene, 2-ethoxyethanol, methoxypropanol, and the like. For most applications, the preferred solvents are mixtures of hydrocarbons that are obtained by the fractional distillation of petroleum and that have from about 8 to 20 carbon atoms, such as gasoline, kerosene, mineral spirits, jet fuel, and mineral seal oil. The amount of solvent used is that which will provide a manganese salt solution having the desired content of dissolved manganese.

The peptizing agents that can be used to stabilize the manganese salt solutions, reduce their viscosities, improve their filterability, and otherwise improve their physical properties include the polyoxyalkylene gylcols, such as tripropylene glycol, that are disclosed in U.S. Pat. No. 2,807,553; the alkyl acid phosphates, such as butyl acid phosphate, that are disclosed in U.S. Pat. No. Re. 23,119; and the alkyl hydroxy acid esters, such as dibutyl tartrate, that are disclosed in U.S. Pat. No. 2,531,460. The preferred peptizing agents are butyl acid phosphate, tripropylene glycol, and mixtures thereof.

The amount of peptizing agent that is used is the smallest amount that will give storage stable, low viscosity manganese salt solutions. In some cases, no peptizing agent need be added to obtain such products, while in others as much as 25% by weight, based on the weight of dissolved manganese in the solution, of a peptizing agent is required. In most cases, from 5% to 20% by weight, based on the weight of dissolved manganese in the solution, of a peptizing agent is incorporated into the manganese salt solutions.

This invention is further illustrated by the following examples. In these examples, all percentages are percentages by weight. The viscosities reported in these examples were determined in accordance with the Gardner-Holdt procedure using a bubble viscosimeter. This method is fully described in various texts including "Stewart's Scientific Dictionary," 4th Edition, published by Stewart Research Laboratory, Alexandria, Va.

EXAMPLE 1

A. A mixture of 65.0 grams (0.91 mole) of manganous oxide, 119.0 grams (0.91 mole) of neoheptanoic acid, 131.5 grams (0.91 mole) of isooctanoic acid, 180 grams of mineral spirits, and 10 grams of a 50% aqueous formic acid solution was heated with mechanical agitation to its reflux temperature (102°–103° C.) and maintained at that temperature for 45 minutes. At the end of that time, almost all of the manganous oxide had dissolved. The reaction mixture, which was a thin brown liquid, was heated to 130° C. to remove water from it. After the addition of 10 grams of tripropylene glycol to it, the solution was filtered to remove unreacted manganese oxide from it and then diluted with sufficient mineral spirits to produce a solution that contained 10% manganese metal. There was obtained 495 grams of the solution of manganese neoheptanoate isooctanoate, which corresponds to a 99% yield. The product, which had a Gardner-Holdt viscosity at 25° C. of A, was stable and soluble in linseed oil. It was suitable for use as a paint drier and as a fuel oil additive.

B. A portion of the solution that contained 10% manganese was concentrated by distillation to increase its manganese content to 12%. This product had a Gardner-Holdt viscosity at 25° C. of T. It was soluble in linseed oil and was stable on standing at ambient temperature.

EXAMPLE 2

The procedure described in Example 1A was repeated, except that 144.5 grams (0.91 mole) of isononanoic acid was used in place of the isooctanoic acid.

The product, which was obtained in a 99.6% yield, was a stable solution that contained 10% manganese metal, had a Gardner-Holdt viscosity at 25° C. of A, and was soluble in linseed oil.

EXAMPLE 3

The procedure described in Example 1A was repeated, except that 158.0 grams (0.91 mole) of isodecanoic acid was used in place of the isooctanoic acid and the amount of mineral spirits was reduced to 160 grams. The product, which was obtained in a 98.8% yield, was a stable solution of manganese neoheptanoate isodecanoate that contained 10% manganese metal. It had a Gardner-Holdt viscosity at 25° C. of G, and it was soluble in linseed oil.

EXAMPLE 4

A mixture of 65 grams (0.91 mole) of manganous oxide, 157 grams (0.91 mole) of Neo Acids, $C_9$ thru $C_{13}$, 131.5 grams (0.91 mole) of isooctanoic acid, 160 grams of hi-flash naphtha which contained 9% $C_8$ alkylbenzenes, 83% $C_9$ alkylbenzenes, and 8% $C_{10}$ alkylbenzenes, and 10 grams of a 50% aqueous formic acid solutiion was heated with mechanical agitation to its reflux temperature (101°–102° C.) and maintained at that temperature for 30 minutes. At the end of that time, almost all of the manganous oxide had dissolved. The reaction mixture, which was a thin brown liquid, was heated to 130° C. to remove water from it. After the addition of 10 grams of tripropylene glycol to it, the solution was filtered and then diluted with hi-flash naphtha to produce a solution that contained 10% manganese metal. The product, obtained in 99.0% yield, was stable, it was soluble in fuel oils, and it had a Gardner-Holdt viscosity at 25° C. of E-F.

EXAMPLE 5

The procedure described in Example 4 was repeated, except that 160.5 grams (0.91 mole) of Neo Acids, $C_5$ thru $C_{25}$, was used in place of the Neo Acids, $C_9$ thru $C_{13}$. The product, which was obtained in 99.2% yield, contained 10% manganese metal. It was stable and soluble in fuel oils, and it had a Gardner-Holdt viscosity at 25° C. of G.

EXAMPLE 6

A mixture of 58.5 grams (0.82 mole) of manganous oxide, 141.5 grams (0.82 mole) of neodecanoic acid, 118.0 grams (0.82 mole) of isooctanoic acid, 190 grams of hi-flash naphtha, and 7 grams of 50% aqueous formic acid was heated with mechanical agitation to its reflux temperature and held at that temperature for 30 minutes. The reaction mixture was then heated to 130° C. to remove water from it. After the addition of 5 grams of tripropylene glycol to it, the solution was filtered and diluted with hi-flash naphtha. The product, obtained in a 99.0% yield, contained 9% manganese metal. It was stable and soluble in fuel oils, and it had a Gardner-Holdt viscosity at 25° C. of A-1.

EXAMPLE 7

A mixture of 65 grams (0.91 mole) of manganous oxide, 160.5 grams (0.91 mole) of Neo Acids, $C_5$ thru $C_{25}$, 131.5 grams (0.91 mole) of isooctanoic acid, 160 grams of mineral spirits, and 10 grams of a 50% aqueous formic acid solution was heated with mechanical agitation to its reflux temperature (101° C.) and maintained at that temperature for 45 minutes. At the end of that time, almost all of the manganous oxide had dissolved. The reaction mixture, which was a thin brown liquid, was heated to 130° C. to remove water from it. After the addition of 5 grams of tripropylene glycol and 5 grams of n-butyl acid phosphate to it, the solution was filtered and then diluted with mineral spirits to produce a solution that contained 10% manganese metal. The product, obtained in a 99.0% yield, was stable and soluble in linseed oil. It had a Gardner-Holdt viscosity at 25° C. of E.

EXAMPLE 8

A mixture of 65 grams (0.91 mole) of manganous oxide, 160.5 grams (0.91 mole) of Neo Acids, $C_5$ thru $C_{25}$, 131.5 grams (0.91 mole) of isooctanoic acid, 160 grams of mineral spirits, and 10 grams of a 50% aqueous formic acid solution was heated with mechanical agitation to its reflux temperature (101° C.) and maintained at that temperature for 45 minutes. At the end of that time, almost all of the manganous oxide had dissolved. The reaction mixture, which was a thin brown liquid, was heated to 130° C. to remove water from it. After the addition of 10 grams of n-butyl acid phosphate to it, the solution was filtered and then diluted with mineral spirits to produce a solution that contained 10% manganese metal. The product, obtained in a 99.1% yield, was stable and soluble in linseed oil. It had a Gardner-Holdt viscosity at 25° C. of D.

EXAMPLE 9

A mixture of 52 grams (0.728 mole) of manganous oxide, 177.5 grams (0.728 mole) of Neo Acids, $C_{10}$ thru $C_{28}$, 105 grams (0.728 mole) of isooctanoic acid, 170 grams kerosene, and 5 grams of a 50% aqueous formic acid solution was heated with mechanical agitation to its reflux temperature (106° C.) and heated at that temperature for 45 minutes. At the end of that time, the reaction mixture, which was a thin dark brown liquid, was heated to 135° C. to remove water from it, filtered, and diluted with kerosene to produce a solution that contained 8% manganese metal in a 97.6% yield. The product, which had a Gardner-Holdt viscosity at 25° C. of I, was soluble in fuel oils and was stable on standing at ambient temperature.

EXAMPLE 10

The procedure described in Example 9 was repeated, except that 213 grams (0.873 mole) of Neo Acids, $C_{10}$ and $C_{28}$, and 84 grams (0.582 mole) of isooctanoic acid were used. The product, obtained in a 97.4% yield, had a Gardner-Holdt viscosity at 25° C. of J. It was soluble in fuel oils and was stable on standing at ambient temperature.

EXAMPLE 11

The procedure described in Example 10 was repeated, except that 142 grams (0.582 mole) of Neo Acids, $C_{10}$ thru $C_{28}$, and 126 grams (0.873 mole) of isooctanoic acid were used. The product, obtained in a 98.5% yield, had a Gardner-Holdt viscosity at 25° C. of H. It was soluble in fuel oils and was stable on standing at ambient temperature.

COMPARATIVE EXAMPLE A

A mixture of 65 grams (0.91 mole) of manganous oxide, 264 grams (1.83 moles) of isooctanoic acid, 160 grams of mineral spirits, and 10 grams of 50% aqueous formic acid solution was heated with mechanical agitation to its reflux temperature (100°–103° C.) and maintained at that temperature for 6 hours. At the end of that time, almost all of the manganous oxide had dissolved, and the reaction mixture had become a viscous brown gel. After the addition of 10 grams of tripropylene glycol, which reduced the gel viscosity only slightly, the reaction mixture was heated to 130° C. to remove water from it and diluted with mineral spirits to produce a solution that contained 10% manganese metal. There was obtained 480 grams of a viscous (Gardner-Holdt viscosity at 25° C. of Z-2 to Z-3), clear brown liquid that was insoluble in linseed oil and other paint vehicles and in fuel oils.

COMPARATIVE EXAMPLE B

A mixture of 65 grams (0.91 mole) of manganous oxide, 289 grams (1.83 moles) of isononanoic acid, 150 grams of mineral spirits, and 10 grams of a 50% aqueous formic acid solution was heated at its reflux temperature for nine hours. At the end of this time, the reaction mixture was heated to130° C. to remove water from it and then diluted with mineral spirits to produce a solution that contained 10% manganese metal. There was obtained 500 grams of a very viscous (Gardner-Holdt viscosity at 25° C. of Z-4 to Z-5), clear brown liquid that was insoluble in linseed oil and other plant vehicles and in fuel oils.

COMPARATIVE EXAMPLE C

A mixture of 65 grams (0.91 mole) of manganous oxide, 238 grams (1.83 moles) of neoheptanoic acid, 200 grams of mineral spirits, and 5 grams of a 50% aqueous formic acid solution was heated with mechanical agitation to its reflux temperature (101° C.) at which point it became almost clear. After 25 minutes at its reflux temperature, the reaction mixture became turbid. It was then heated to about 135° C. to remove water from it. During this heating, granular brown solid deposits formed on the walls of the reaction vessel. Ten grams of propylene glycol was added, and the reaction mixture was diluted with mineral spirits to bring its manganese content to 10%. There was obtained 480 grams of a solution that after standing at room temperature for 16 hours separated into a thin, clear, dark brown, upper liquid phase (about 67% by volume) and a brown granular solid phase (about 33% by volume). This two-phase product was unsuitable for commercial use as a paint drier or as a fuel oil additive.

EXAMPLE 12

Equimolar amounts of the viscous product of Comparative Example B (manganese isononanoate) and the two-phase product of Comparative Example C (manganese neoheptanoate) were mixed and heated to 130° C. to form a uniform solution and then heated at 130° C. for 20 minutes. The solution was filtered and then diluted with mineral spirits to produce a solution that contained 10% manganese metal. The product, which was obtained in an overall yield of 99.2%, had a Gardner-Holdt viscosity at 25° C. of A. It was soluble in linseed oil and stable on standing at ambient temperature.

COMPARATIVE EXAMPLE D

A mixture of 65 grams (0.91 mole) of manganous oxide, 313.5 grams (1.83 moles) of Neo Acids, $C_9$ thru $C_{13}$, 135 grams of mineral spirits, and 5 grams of a 50% aqueous formic acid solution was heated with mechanical agitation to its reflux temperature (103° C.). It became almost clear 5 minutes after it reached this temperature. After another 10 minutes at its reflux temperature, the reaction mixture became very turbid. It was then heated to 132° C. to remove water from it. During the drying period, a brown solid precipitate was formed. After the addition of 10 grams of tripropylene glycol and sufficient mineral spirits to reduce its manganese metal content to 10%, there was obtained 480 grams of a product that became a soft, dark brown solid after standing at room temperature for a few hours. This insoluble product was unsuitable for commercial use as a paint drier or as a fuel oil additive.

What is claimed is:

1. A stable manganese salt solution containing at least 6% by weight of dissolved manganese that comprises
(a) manganese salts derived from a saturated, branched-chain, aliphatic monocarboxylic acid component that contains 40 to 75 mole percent of a first acid component that contains one or more alpha, alpha-disubstituted acids having 5 to 28 carbon atoms and 25 to 60 mole percent of a second acid component that contains 50 to 100 mole percent of one or more beta-substituted acids having 6 to 18 carbon atoms and 0 to 50 mole percent of one or more acids substituted in a position further removed fromthe carboxyl group;
(b) 0 to 25% by weight, based on the weight of dissolved manganese in said solution, of a peptizing agent; and
(c) an inert organic solvent.

2. A stable manganese salt solution as set forth in claim 1 that contains 8% to 12% by weight of dissolved manganese.

3. A stable manganese salt solution as set forth in claim 1 that contains not more than 20% by weight, based on the weight of dissolved manganese in said solution, of a peptizing agent selected from the group consisting of alkyl acid phosphates, polyoxyalkylene glycols, alkyl hydroxy acid esters, and mixtures thereof.

4. A stable manganese salt solution as set forth in claim 3 wherein the peptizing agent is butyl acid phosphate.

5. A stable manganese salt solution as set forth in claim 3 wherein the peptizing agent is tripropylene glycol.

6. A stable manganese salt solution as set forth in claim 1 that comprises manganese salts derived from a saturated, branched-chain, aliphatic monocarboxylic acid component that contains 40 to 75 mole percent of at least one alpha, alpha-disubstituted acid having 7 to 13 carbon atoms and 25 to 60 mole percent of at least one beta-substituted acid having 7 to 10 carbon atoms.

7. A stable manganese salt solution as set forth in claim 1 that additionally contains one or more manganese salts selected from the group consisting of manganese salts of said alpha, alpha-disubstituted acids having 5 to 28 carbon atoms, manganese salts of said beta-substituted acids having 6 to 18 carbon atoms, and mixtures thereof.

8. A stable manganese salt solution as set forth in claim 1 that comprises manganese salts derived from an acid component that contains substantially equimolar amounts of the alpha, alpha-disubstituted acid component and the beta-substituted acid-containing component.

9. A stable manganese salt solution as set forth in claim 1 wherein the inert organic solvent comprises a hydrocarbon.

10. A stable manganese salt solution as set forth in claim 1 that comprises
(a) manganese salts derived from an acid component that contains substantially equimolar amounts of Neo Acids, $C_5$ thru $C_{25}$, and isooctanoic acid;
(b) not more than 20% by weight, based on the weight of dissolved manganese in said solution, of a peptizing agent; and
(c) a hydrocarbon solvent.

11. The process for the production of stable manganese salt solutions that contain at least 6% by weight of dissolved manganese that comprises contacting manganous oxide with a saturated, branched-chain, aliphatic monocarboxylic acid component that contains 40 to 75 mole percent of a first acid component that contains one or more alpha, alpha-disubstituted acids having 5 to 28 carbon atoms and 25 to 60 mole percent of a second acid component that contains 50 to 100 mole percent of one or more beta-substituted acids having 6 to 18 carbon atoms and 0 to 50 mole percent of one or more acids substituted in a position further removed from the carboxyl group in an inert organic solvent at a temperature in the range of about 90° C. to 125° C. until substantially all of the manganous oxide has reacted and a manganese salt solution has been formed and incorporating into said solution not more than 25% by weight, based on the weight of dissolved manganese in said solution, of a peptizing agent.

12. The process of claim 11 wherein the stable manganese salt solution contains 8% to12% by weight of dissolved manganese.

13. The process of claim 11 wherein the stable manganese salt solution contains not more than 20% by weight, based on the weight of dissolved manganese in said solution, of a peptizing agent selected from the group consisting of alkyl acid phosphates polyoxyalkylene glycols, alkyl hydroxy acid esters, and mixtures thereof.

14. The process of claim 11 wherein the acid component comprises alpha, alpha-disubstituted monocarboxylic acids having 7 to 13 carbon atoms and beta-substituted monocarboxylic acids having 7 to 10 carbon atoms.

15. The process of claim 11 wherein the acid component contains substantially equimolar amounts of the alpha, alpha-disubstituted acid component and the beta-substituted acid-containing component.

16. The process of claim 11 wherein the inert organic solvent comprises a hydrocarbon.

17. An oil-soluble manganese salt composition that comprises manganese salts derived from a saturated, branched-chain, aliphatic monocarboxylic acid component that contains 40 to 75 mole percent of at least one alpha, alpha-disubstituted acid having 5 to 28 carbon atoms and 25 to 60 mole percent of at least one beta-substituted acid having 6 to 18 carbon atoms.

18. An oil-soluble manganese salt composition as set forth in claim 17 that additionally contains one or more manganese salts selected from the group consisting of manganese salts of said alpha, alpha-disubstituted acids, manganese salts of said beta-substituted acids, and mixtures thereof.

19. An oil-soluble manganese salt composition as set forth in claim 18 that comprises manganese salts derived from an acid component that contains substantially equimolar amounts of said alpha, alpha-disubstituted acid component and said beta-substituted acid-containing component.

20. An oil-soluble manganese salt composition as set forth in claim 17 wherein the alpha, alpha-disubstituted acids have 7 to 13 carbon atoms and the beta-substituted acids have 7 to 10 carbon atoms.

21. An oil-soluble manganese salt composition as set forth in claim 18 wherein the manganese salts are derived from Neo Acids, $C_5$ thru $C_{25}$, and isooctanoic acid.

22. An oil-soluble manganese salt derived from two structurally-different saturated, branched-chain, aliphatic monocarboxylic acids, one of which is an alpha, alpha-disubstituted acid having 5 to 28 carbon atoms and the other of which is a beta-substituted acid having 6 to 18 carbon atoms.

23. An oil-soluble manganese salt as set forth in claim 22 that is derived from an alpha, alpha-disubstituted acid having 7 to 13 carbon atoms and a beta-substituted acid having 7 to 10 carbon atoms.

* * * * *